United States Patent [19]

Wong

[11] 3,952,343

[45] Apr. 27, 1976

[54] AUTOMATIC BABY CRIB ROCKER

[76] Inventor: Gim Wong, 1849 Gibbs Road, Estevan, Saskatchewan, Canada

[22] Filed: July 29, 1974

[21] Appl. No.: 492,416

[52] U.S. Cl. ..... 5/109; 318/128
[51] Int. Cl.[2] ..... A47D 9/02
[58] Field of Search ..... 5/109; 179/1 VC; 340/148; 318/128; 307/141.4

[56] References Cited

UNITED STATES PATENTS

| | | | |
|---|---|---|---|
| 1,500,009 | 7/1924 | Smaldone | 5/109 |
| 2,945,168 | 7/1960 | Steinke | 318/128 |
| 3,031,686 | 5/1962 | Muzzey | 5/109 |
| 3,089,130 | 5/1963 | Wilson | 340/279 |
| 3,125,767 | 3/1964 | Griggs et al. | 5/109 |
| 3,261,033 | 7/1966 | Martin | 5/109 |
| 3,458,772 | 7/1969 | Egart et al. | 307/141.4 X |
| 3,681,613 | 8/1972 | Flieder et al. | 307/141.4 |
| 3,780,319 | 12/1973 | Korom | 307/303 X |

*Primary Examiner*—Roy D. Frazier
*Assistant Examiner*—Rodney H. Bonck
*Attorney, Agent, or Firm*—Stanley G. Ade

[57] ABSTRACT

Conventional crib rockers and the like are operated mechanically by means of an electric motor linkage and a timer mechanism connected to the cradle portion of the crib which is mounted in pivots upon the frame and they are normally switched on and off as required. The present device is electronically actuated and may be connected to a conventional crib which is often manually rocked by pushing and pulling on the foot or headboard to give the slight rocking action desired. The device is preferably actuated by a baby's voice picked up by a microphone or microphones and the periodicity and duration of the rocking may be adjusted within limits. It can also be set into motion by manual actuation of a switch.

3 Claims, 5 Drawing Figures

AUTOMATIC BABY CRIB ROCKER

BACKGROUND OF THE INVENTION

This invention relates to new and useful improvements in crib rocking devices.

Conventionally, automatic baby rocking devices employ a relatively noisy motor and gear reducer systems to actuate the rocking or swinging motion and usually require a specially built crib in which the body portion is pivotally mounted to the frame. This is costly to manufacture, complicated to install, bulky and noisy.

Most of the conventional devices are not fully automatic inasmuch as when the baby is crying, an attendant has to switch on the rocking device.

SUMMARY OF THE INVENTION

The present invention overcomes all of the above mentioned disadvantages by providing a device which is easily attached to a conventional crib or which, alternatively, can be attached to a pivotally mounted type crib.

The principal object and essence of the invention is to provide a device of the character herewithin described which although it can be actuated manually, is normally actuated by the baby's cry impinging upon a microphone which starts the crib rocking action.

Another object of the invention is to provide a device of the character herewithin described which includes a sensitivity control so that only the baby's voice will actuate the crib rocking action, and which furthermore includes a timer so that the duration of the rocking action can be controlled also. Further circuitry also allows the attendant to set the periodicity of the rocking action depending upon the construction of the crib and the desires of the attendant.

A still further object of the invention is to provide a device of the character herewithin described which is very simply attached to a conventional crib in order to give the normal relatively short throw type of rocking action desired. With conventional cribs, it is quite normal to grasp the head or footboard and just rock the crib slightly using the flexibility of construction in order to give the necessary to and fro action.

Another object of the invention is to provide a device of the character herewithin described in which the electronic portion can either be transistorized or, alternatively, can readily be adapted for use with integrated circuits.

A still further object of the invention is to provide a device of the character herewithin described which is simple in construction, economical in manufacture and otherwise well suited to the purpose for which it is desired.

With the foregoing objects in view, and other such objects and advantages as well become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 4:
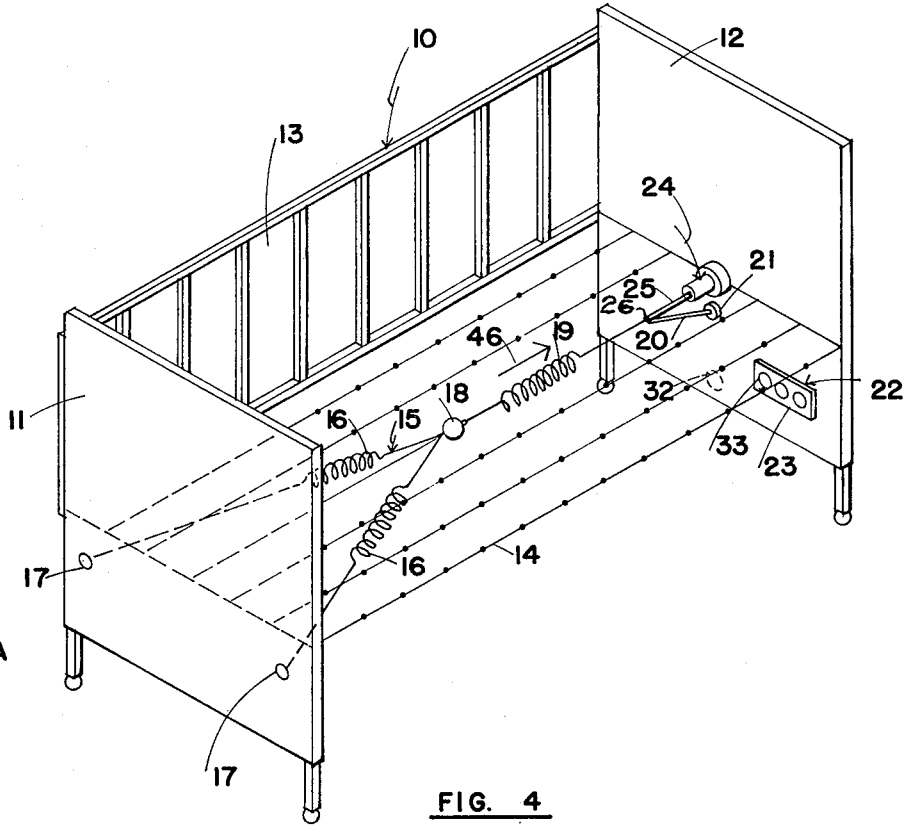
FIG. 4 is a fragmentary isometric view of a conventional crib showing the spring system attached thereto.

Proceeding therefore to describe the invention in detail, reference should first be made to FIG. 4 in which 10 generally illustrates a crib having a headboard 11, a footboard 12 and barred sides 13, only one of which is illustrated.

A wire spring frame 14 normally spans the crib intermediate the upper and lower sides thereof and upon this wire spring 14, the conventional crib mattress (not illustrated) is supported.

A normally stable spring system collectively designated 15 is provided with the invention and consists of a pair of springs 16 being secured by one end thereof and spaced apart as at 17 on the headboard 12. The other ends of these springs are connected to a common locus 18 and a third spring 19 is connected by one end thereof to this locus and extends towards the footboard 11.

A relatively short length of cable 20 is connected to the other end of spring 19 and in turn extends to an anchor point 21 on the headboard 11 and means are provided as well hereinafter be described, to pull on the spring 19 and to release this pull at an adjustable periodicity thus extending springs 16 and 19 and releasing them alternately thus giving the desired slight rocking action to the crib in a lengthwise direction, similar to a person rocking the crib by grasping the top of the foot or headboard and moving same fore and aft very slightly.

Reference character 22 illustrates the electronic package to accomplish the desired motion and this can be enclosed within a casing 23 and attached to the head or footboard underneath the wire spring frame 14.

The electronic package includes a solenoid coil assembly collectively designated 24 which in turn includes the moving solenoid 25 extending from one end thereof and the end of this solenoid 25 is connected to the end of spring 19 where same joins cable 20, said point of attachment being indicated in FIG. 4 by reference character 26.

Figure 1:
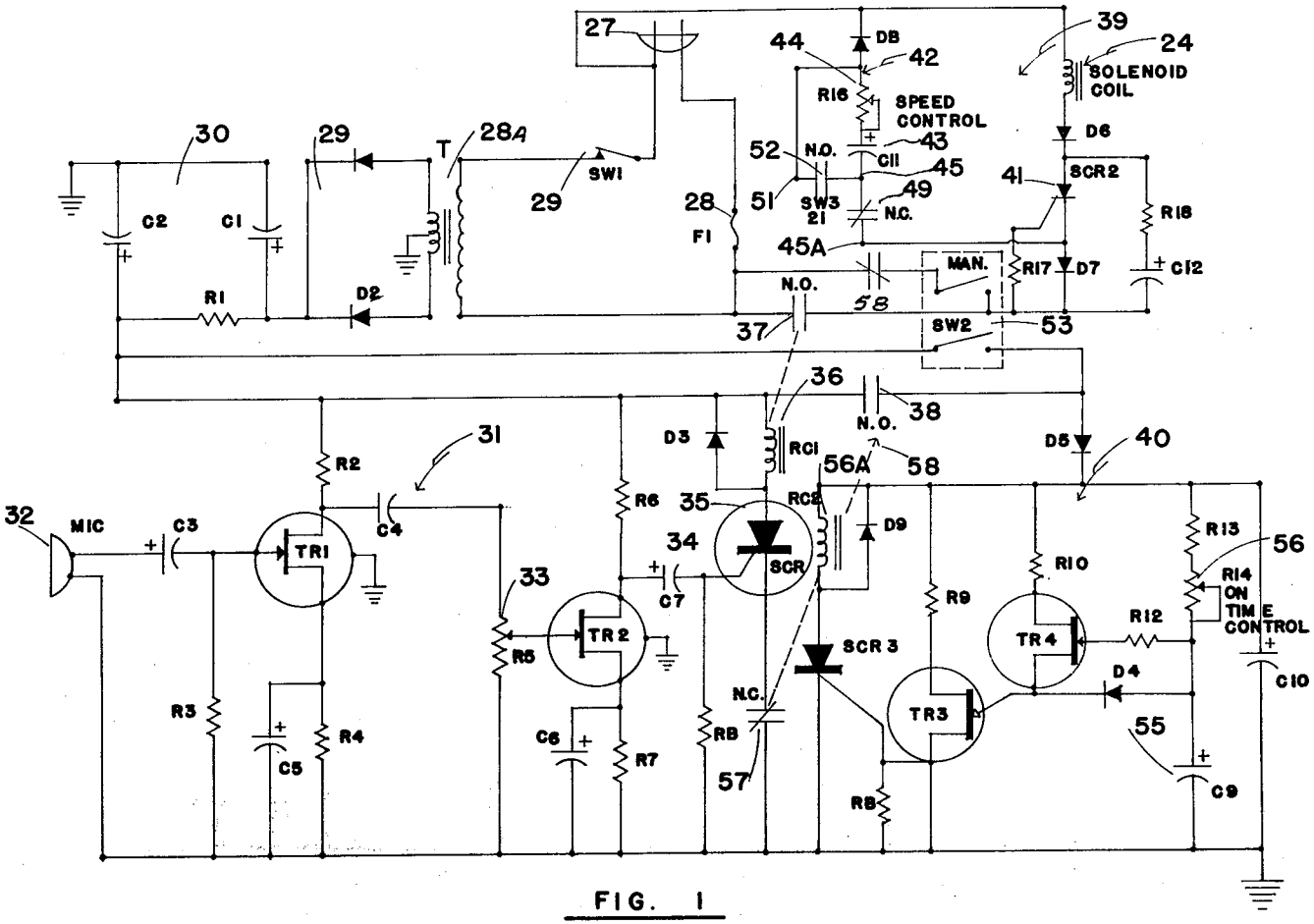
FIG. 1 is a schematic wiring diagram showing a transistorized circuit.

The circuitry of the electronic package 23 is shown in detail in FIG. 1. It includes a power supply input 27 one side of which is fused as at 28. A main switch 29 is also included and this power supply is connected to a transformer 28A, the output of which is rectified by diodes 29.

D.C. Current is filtered by means of capacitors 30 and connected to an audio amplifier circuit collectively designated 31.

This circuit includes a microphone or microphones 32 which is situated near the crib but out of reach of the occupant thereof. Any sound picked up by the microphone is transmitted through condenser C3 to the first stage or transistor TR1 of the high gain audio amplifier 31.

The output from TR1 is connected to the base of the second transistor TR2 via the sensitivity control 33 and this control permits the operation of the device to be adjusted to respond to the baby's cry and not to extraneous sounds.

Therefore, when the baby cries, the sound is picked up by the microphone which sound is amplified by TR1 and TR2 to provide a relatively large A.C. output voltage at point 34.

This is connected to a silicon controlled rectifier (SCR1) identified by reference character 35 and triggers this rectifier which in turn operates a solenoid coil (RC1) identified by reference character 36. The operation of this solenoid coil 36 closes normally open switches 37 and 38. Normally open switch 37, when closed, connects the power supply from 27, to the solenoid coil control circuit portion collectively designated 39.

The closing of the normally open switch 38 connects the rectified current to the timer control circuit portion collectively designated 40.

Summarizing therefore, there is no voltage at point 34 until the baby cries at which time voltage appears at 34 to operate the silicon control rectifier 35 and to close switches 37 and 38.

The solenoid coil 36 is used in conjunction with a double-pull double-throw relay which includes the aforementioned switches or contacts 37 and 38.

Dealing first with the operation of the solenoid coil portion of the circuit 39, this includes a further silicon controlled rectifier 41 (SCR2) and a speed control mechanism collectively designated 42. This includes a condenser 43 (C11) and an adjustable potentiometer 44 (R16) inserted as shown. During half cycles of the A.C. current from the power supply 27, when the anode of (SCR2) 41 is positive, the charging current for condenser 43 (C11) passes through R17 to the gate of 41 (SCR2) and through normally closed switch 49 to point 45A. It then passes through condenser 43, through the adjustable potentiometer 44 and thence through diode D8 to complete the circuit which will thus trigger the rectifier 41 (SCR2) thus actuating the solenoid coil assembly 24. This pulls solenoid 25 in the direction of arrow 46 (see FIG. 4) thus extending the springs of the system 15.

Figure 2:
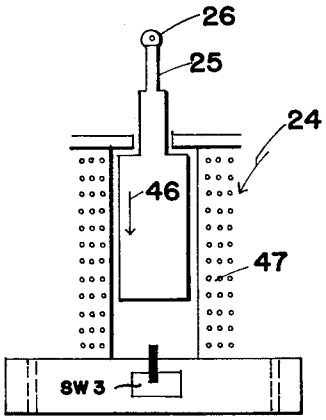
FIG. 2 is an enlarged partially sectioned schematic view of the solenoid showing the switch mechaism connected thereto.
Figure 3:
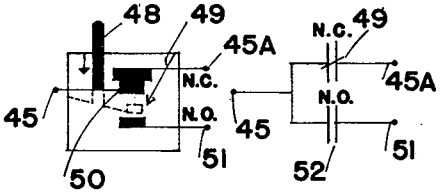
FIG. 3 is a schematic wiring diagram of the switch mechanism shown in FIG. 2.

Reference to FIG. 2 will show the switching mechanism 49 within the solenoid assembly 24.

When the coil 47 is energized as aforesaid, the solenoid 25 moves in the direction of arrow 46 until it strikes the actuator 48 of switch 49 (SW3). The movable contact 50 is connected to point 45 (see FIG. 1) and being a normally closed switch, the connection is between point 45 and point 45A thus indicated in FIG. 1 by the normally closed switch 49.

However, when the solenoid 25 strikes the actuator 48, it moves away from its normal contact to a contact 51 thus closing what is normally open switch 52. This, of course, disconnects the current from the solenoid coil 47 thus permitting the spring system 15 to withdraw the solenoid 25 to the uppermost position shown in FIG. 2. This permits the actuator 48 to return to the original position thus closing switch 49 and opening switch 52 and once again re-energizing the solenoid coil assembly 24.

By the adjustment of R16 (potentiometer 44) the periodicity of the actuation of the solenoid coil assembly can be controlled.

It will also be observed that a double-pull double-throw switch 53 is inserted which can be closed manually to initiate the rocking action rather than waiting for the baby's cry to actuate the audio amplifier circuitry 31.

Summarizing, the charging of condenser C11 triggers the rectifier 41 (SCR2) thus actuating the solenoid coil which in turn actuates the switch (SW3) 49 which in turn breaks the circuit to the solenoid coil 47 so that the cycle is repeated, controlled by the speed control 44.

The holding current of the rectifier 41 (SCR2) is also controlled by the combination of R18 and C12 as clearly illustrated in FIG. 1.

The timer circuit 40 controls the length of time that the solenoid coil assembly 24 operates when in the automatic mode shown in FIG. 1. This circuit includes a condenser 55 (C9) which takes a certain time to charge, controlled by an adjustable potentiometer 56 in circuit therewith. When charged, it triggers transistor TR3 to energize a further relay control 56A which thus opens a normally closed switch 57 in the cathode circuit of the rectifier 35 (SCR1) which thus returns to the non-conducting state and therefore de-energizes the solenoid coil 36 opening switches or contacts 37 and 38 and thus de-activating the mechanism until such time as the baby cries again which will be picked up by microphone 32. The delay time or time operating is dependent upon the RC time constant of R13, R14 and condenser C9 (55).

As mentioned previously, the mechanism can be manually actuated by closing the manual switch 53. Under these circumstances, the solenoid coil assembly 53 also actuates a normally closed contact or switch 58 in the manual circuit to the solenoid coil assembly 39.

Figure 5:
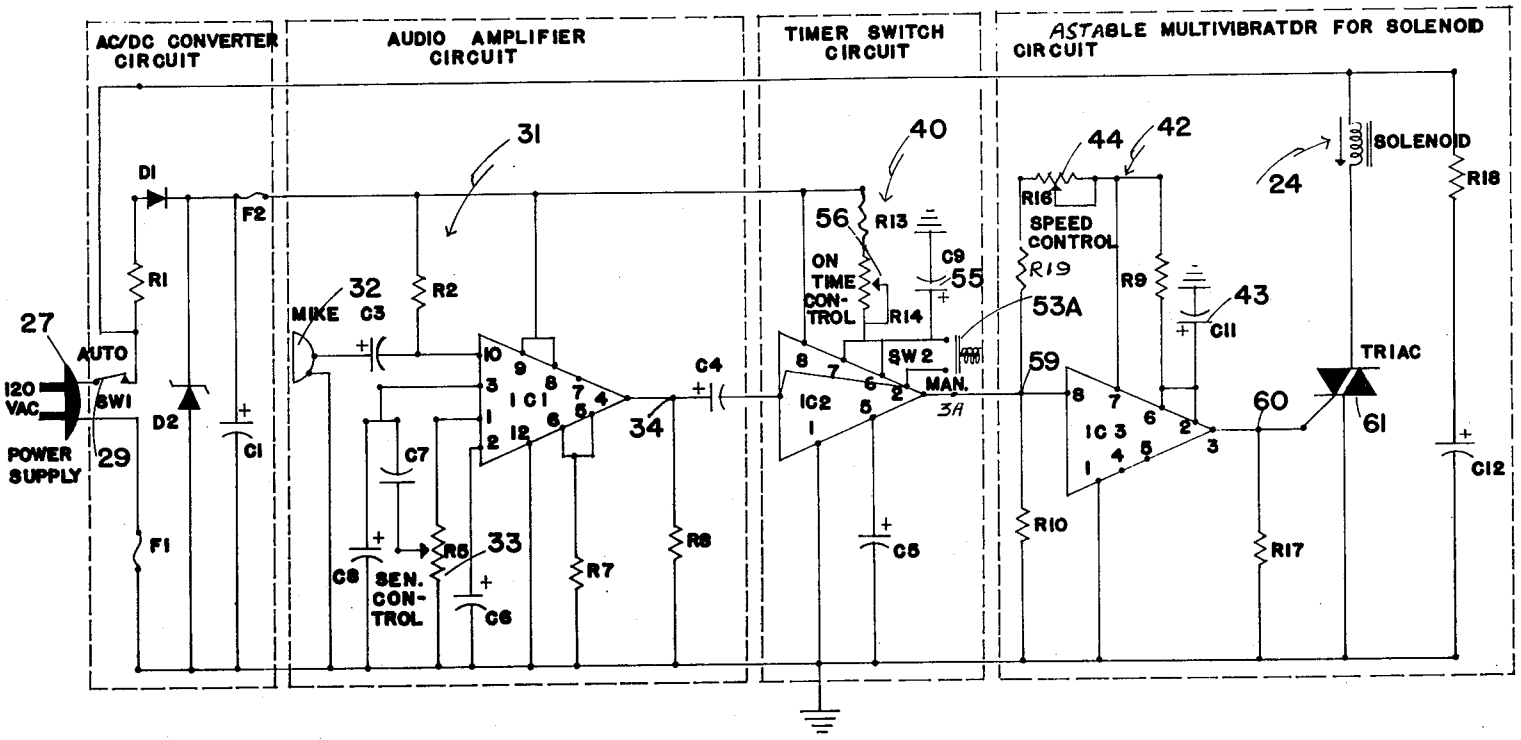
FIG. 5 is a schematic wiring diagram similar to FIG. 1, but showing integrated circuits incorporated therein.

FIG. 5 shows the circitry similar to FIG. 1 but adapted for use with integrated circuits and where applicable, similar reference characters have been used.

The baby's cries are picked up by microphone 32 and fed to the amplifier circuit and the signal is amplified by IC1 together with the sensitivity control 33. The ouptut voltage from IC1 appears at point 34 to switch the timer circuit 40 on. Therefore the output of IC2, pin 3, is high or equal approximately to B+ voltage at 59. The amount of time delay depends on the RC time constant R13 R14, R13, and C9.

The output from timer circuit IC2 appears at point 59 and is connected to the astable multivibrator circuit 42 and to the speed control potentiometer 44 (R16) to provide B+ voltage to operate this circuit 42 and IC3. The output of IC3 at point 60 is connected to the gate of a triac 61 which in turn operates the solenoid coil assembly 24 in a manner hereinbefore described.

The timer switch circuitry 40 takes the form of a monostable multivibrator and the solenoid circuitry for solenoid 24 takes the form of an astable multivibrator.

Summarizing, the microphone 32 picks up the signal from the baby and this signal is amplified by IC1 thus giving a signal at point 34 which triggers IC2. This turns IC2 on and its output at pin 3 of IC2 is high and equal approximately to the B+ voltage. The length of time that the signal appears at 59 is determined by the timer potentiometer 56 and is determined by the RC time constant of the values of R13, R14 and C9 as hereinbefore described.

When point 59 is at B+ potential, the astable multivibrator circuit is operated and the output of IC3 at point 60 triggers the triac 61. This triggered voltage at point 60 triggers the triac on and off, the periodicity being determined by the speed control 44 (R19, R16 + R9 C11) to energize and de-energize the solenoid 24. This circuitry of course eliminates the necessity for the solenoid switch 49 (SW3) thus simplifying the circuitry still further.

After the set period of time set by time control, potentiometer 56 (R14), IC2 stops conducting so that the voltage is practically 0 at point 59. This therefore switches off the astable multivibrator circuitry to stop the rocking action until the next time the device is actuated by operation of microphone 32.

Manual switching means 53A is also provided in the form of a spring-loaded pushbutton to trigger the timer switch circuitry 40 manually. The operation of the astable circuitry is once again controlled by the speed control potentiometer 44 (R16) R19, R9 and C11.

The integrated circuits used in FIG. 5 are as follows:

RC1 - CA3020 RC2 - NE555 or MC - NE555
MC - 1555
RC3 - NE555 or MC1555

However, all three integrated circuits can of course be replaced by other integrated circuits on the market having similar operating characteristics.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A voice actuated rocking mechanism for operative attachment to a baby's crib or the like and including a source of electrical power; comprising in combination a normally stable spring system operatively connected to the associated crib, solenoid coil means operatively connected to said spring system and being connectable to said source of electrical power, a microphone, an audio amplifier circuit operatively connected to said microphone and to said source of electrical power, means operated by the output of said audio amplifier circuit to operate said solenoid coil means and being connectable to said source of electrical power, a timer circuit for disconnecting said solenoid coil means from said means operated by the output of said audio amplifier circuit and from said source of electrical power, said timer circuit including means to adjust the duration of said timer circuit within limits by an RC time constant, means operatively connected to said solenoid coil means to make and break the electrical circuit thereto, manually operated switch means operatively connected to said circuit to initiate said rocking action manually if desired and adjustable speed control means operatively connected to said solenoid coil means to control the actuation of said means to make and break the electrical circuit to said solenoid coil means.

2. The device according to claim 1 in which said audio amplifier circuit includes at least one stage amplifying transistor in circuit with said microphone, said audio amplifier circuit including means whereby said transistor conducts when sounds impinge upon said microphone, further solenoid coil means, a silicon control rectifier being connected to the output of said transistor and being operatively connected to said further solenoid coil means, a switch in circuit between said source of electrical power and said first mentioned solenoid coil means and a further switch in circuit between said source of electrical power and said timer circuit, the operation of said further solenoid coil means by said silicon control rectifier, operating said switches to close said switches when said silicon control rectifier is actuated and to open said switches when silicon control rectifier is deactivated.

3. The device according to claim 1 in which said audio amplifier circuit takes the form of an integrated circuit operatively connected to said microphone, said timer circuit comprising a monostable multivibrator in the form of an integrated circuit operatively connected to said audio amplifier circuit, said means to operate said solenoid coil means includes a further integrated circuit in the form of an astable multivibrator operatively connected to the output of said second mentioned integrated circuit, and a triac operatively connected between said solenoid coil means and said last mentioned integrated circuit.

* * * * *